US005755905A

United States Patent [19]

Sinn et al.

[11] Patent Number: 5,755,905

[45] Date of Patent: May 26, 1998

[54] METHOD OF MAKING PRESSURE SENSITIVE ADHESIVE TAPE ROLLS WITH A TRANSPARENT TO THE CORE APPEARANCE

[75] Inventors: Michael J. Sinn, Inver Grove Heights; Ronald P. Swanson, Woodbury, both of Minn.

[73] Assignee: Minnesota Mining and Manufacturing Company, St. Paul, Minn.

[21] Appl. No.: 903,268

[22] Filed: Jul. 25, 1997

Related U.S. Application Data

[63] Continuation of Ser. No. 204,778, Mar. 2, 1994, abandoned.

[51] Int. Cl.[6] ..... B65H 18/00

[52] U.S. Cl. ..... 156/184; 156/187; 242/520

[58] Field of Search ..... 156/184, 185, 156/187, 188, 271, 443, 446; 242/520

[56] References Cited

U.S. PATENT DOCUMENTS

| | | | |
|---|---|---|---|
| 2,702,772 | 2/1955 | Pronio . | |
| 2,855,161 | 10/1958 | Ganz et al. . | |
| 3,670,980 | 6/1972 | Mukai et al. | 242/67.1 R |
| 4,092,886 | 6/1978 | Nowisch | 242/56.7 X |
| 4,150,797 | 4/1979 | Kataoka | 242/67.1 R |
| 4,342,432 | 8/1982 | Lund et al. | 242/56.2 |
| 4,572,452 | 2/1986 | Driscoll et al. | 242/56.2 |
| 4,715,552 | 12/1987 | Matsumoto | 242/56 A |
| 4,846,416 | 7/1989 | Natale | 242/56 A |
| 4,921,567 | 5/1990 | Criswell, Jr. | 156/446 X |

FOREIGN PATENT DOCUMENTS 45-11640 4/1970 Japan .

OTHER PUBLICATIONS

Brochure entitled "NG 210" from Guzzetti s.p.a., Italy (no date).

"Slitting" (Chapter 37) in *Handbook of Pressure Sensitive Adhesives*, edited by Donatas Satas, 2nd ed., copyright 1989, pp. 885–890.

*Standard Test Method for Haze and Luminous Transmittance of Transparent Plastics*, ASTM Designation D1003–61 (Reapproved 1988), 6 pages.

*Standard Test Method for Holding Power of Pressure–Sensitive Tape*, ASTM Designation D3654–88, 4 pages.

*Primary Examiner*—James Engel

*Attorney, Agent, or Firm*—Charles D. Levine

[57] ABSTRACT

The method of the present invention provides a way to make rolls of high shear strength pressure sensitive adhesive tapes with a transparent to the core appearance in a relatively short time and without the need to subject the rolls to additional method steps. Moreover, the present invention achieves such transparent to the core appearance by sufficiently wetting-out the adhesive on the tape backing to remove microscopic air bubbles entrapped within the harder and less deformable high shear strength adhesive layers. The method comprises a rewinding method and is characterized by the use of a pack roll during rewinding to provide a sufficiently high contact pressure to the non-adhesive side of the tape substantially at the application point of the tape to the tape roll. In one aspect, a sufficient contact pressure is provided by the pack roll so that the pressure sensitive adhesive tape rolls are made with a transparent to the core appearance at the time of the rewinding step. In another aspect, the method further includes the step of aging the tape roll after the rewinding step is complete for allowing the tape roll to become transparent to the core after the rewinding step.

5 Claims, 1 Drawing Sheet

METHOD OF MAKING PRESSURE SENSITIVE ADHESIVE TAPE ROLLS WITH A TRANSPARENT TO THE CORE APPEARANCE

This is a continuation of application Ser. No. 08/204,778 filed Mar. 2, 1994, now abandoned.

TECHNICAL FIELD

The present invention relates to a method of preparing pressure sensitive adhesive tape rolls having a clear or transparent to the core appearance. More specifically, the present invention is directed to the making of such transparent to the core tape rolls comprising pressure sensitive adhesives having relatively high shear holding strength values.

BACKGROUND

Pressure sensitive adhesive tapes are typically provided in roll form, having various diameter cores and provided with various tape lengths wound about the cores. Common packaging or box sealing tapes are provided on three-inch diameter cores and are provided with up to 100 yards or more of pressure sensitive adhesive tape.

Such packaging and box sealing tapes generally comprise a backing layer which is coated on one side with a pressure sensitive adhesive layer and which may also be treated or coated on the other side with what is known in the art as a low-adhesion backsize so that the tape separates easily when unwound from the roll. In the class of such tapes to which the present invention is directed, each of the backing layer, the low-adhesion backsize treatment, and the adhesive are preferably transparent.

In the manufacturing of such pressure sensitive adhesive tape rolls, large rolls comprising an adhesive coated film, as above, are unwound and slit longitudinally down into the narrow tape widths of the end product tape rolls and then rewound on cores of approximately the same width as the slit tape. Core sizes may vary; however, the industry standard for packaging and box sealing tapes is about three inch (7.62 cm) core diameters.

In the rewinding of the individual tape rolls after slitting, the tape is wound about each core with the adhesive layer of each subsequent wind against the treated non-adhesive surface of the backing material of the previous layer. Because of this rewinding operation, microscopic and sometimes even more macroscopic air pockets become entrapped within the adhesive layers between subsequent backing layers. Thus, even with the use of transparent backings and adhesives, the trapped air pockets, particularly the microscopic pockets, give the finished tape roll an overall cloudy or non-transparent appearance.

Winding techniques can be generally classified in accordance with the manner by which the individual rolls are driven and the way that the tape is applied thereto. The two basic techniques are either a center-wind method wherein the core being wound with tape is driven about its center axis, or a surface-wind method where the driving is accomplished by a driven roll that rotates against the outer tape roll surface while the core acts as an idler about its central axis. In regard to pressure sensitive adhesive tapes, center-winding is the prevalent basic method of winding such tapes.

Hybrid methods have also been used which combine surface- and center-winding. The hybrid techniques are used primarily to assist in tension control and to avoid wrinkles.

More specifically, it is known to use what is known as a "top-riding roll" or "pack roll" in addition to center-winding. Such pack rolls are urged against the outer surface of the tape roll while the core is driven and apply the tape to the core. The pack roll may be an idler or may also be driven to assist in controlling and reducing tape tension. Moreover, the force of the pack roll against the tape helps remove wrinkles and prevents large air bubbles or balloons from forming between layers. Such entrapped air can create an unstable roll that may sag, telescope, or become out-of-round.

However, as set forth above, it is required that the microscopic air bubbles that form within the adhesive layer of a transparent adhesive on a transparent backing tape or between the adhesive and the backing layer be substantially eliminated in order to produce a tape roll having a transparent to the core appearance. With low shear holding strength adhesives, which are typically very soft and deform easily, such transparent to the core rolls can be obtained by the use of conventional pack rolls which apply enough pressure to wet-out the soft adhesive, that is to substantially remove microscopic air bubbles. In fact, very soft adhesives don't even need any pack roll pressure to give complete wetting; such can be accomplished by web tension alone.

Conventional pack roll type slitters apply pressures of up to about four pounds per lineal inch (PLI), but usually less than 2 PLI, which is generally all that is required in order to remove wrinkles and macroscopic air bubbles as described above. Furthermore, such conventional pack rolls apply sufficient pressure against the soft low shear holding strength pressure sensitive adhesive tapes during rewinding to provide a transparent to the core appearance. More specifically, because the adhesive is soft, the relatively low pressures associated with pack rolls are more than sufficient for removing the microscopic air bubbles and making a uniform homogeneous layer of the adhesive on the tape backing. This ability is hereinafter referred to as the "wetability" of the adhesive on the tape backing.

Low shear holding strength values are defined in accordance with the present invention as those having less than 400 minutes of holding power as defined by ASTM D-3654 Standard Test Method for Holding Power of Pressure Sensitive Tape. This test measures the ability of the adhesive to withstand a shear force over time. Basically, a standard size tape specimen is applied to a test surface with a controlled pressure. The tape is subjected to a shear force by use of a specified mass acting parallel to the surfaces of the specimen. After the specified mass is applied, it is timed until failure. The time between the application and failure determines the value denoted in minutes.

Low shear holding strength values associated with the adhesive tapes known to be made transparent to the core with conventional center-winding or pack roll slitting operations are those below 100 minutes, which values are typical for acrylate polymer based pressure sensitive adhesives. However, values of below 400 minutes are generally considered as low holding strength values which are common to many acrylic-based adhesive tapes and many other natural and synthetic rubber-based adhesive tapes.

Such pack roll slitting and winding machines have heretofore been unable to produce transparent to the core tape rolls comprising tape having relatively high shear holding strength values. As above, they have been used at conventional pressures to reduce wrinkles and remove macroscopic air bubbles in addition to assist in tension control. Such higher shear holding strength values are considered those above 400 minutes as defined by the ASTM D-3654 Standard Test. More particularly, values of greater than 1,000 minutes are considered of significantly high strength. Typically, such higher shear holding strength adhesives are those made of natural or block copolymer rubbers blended with tackifying resin and cross-linked adhesives of all types. The use of high shear strength adhesives is desired in many situations, such as in packaging, when greater holding power is desired by a user for a particular application. Such higher shear holding strength adhesives are also typically harder and less deformable than the low shear strength adhesives discussed above, and it is, thus, much more difficult to remove microscopic entrapped air bubbles.

One manner of producing transparent to the core tape rolls comprising a higher shear holding strength adhesive is described in the published Japanese Kokai patent application 45-11640. Described is a treatment method for tape rolls having pressure sensitive adhesive of the type comprising natural and synthetic rubbers. According to this method, the roll of tape, which could be after rewinding, is treated in an environment of increased temperature and high pressure for a relatively short period of time, about one hour or less. Such treatment has been found to provide a transparent to the core tape roll for the specific tape constructions recited therein.

Also within this Japanese reference, it is described that such transparent to the core tape rolls can also be provided by the method of providing pressure to the outside of the tape during winding on the core, and that after a period of 3–4 months, the air that is present in the microscopic pores between the layers is eliminated by the expansion and contraction of the base film itself. In other words, it is described that a tape that is wound while under some surface pressure, presumably conventional pressures, may clear up after a significant period of aging.

SUMMARY OF THE PRESENT INVENTION

The method of the present invention overcomes the shortcomings and disadvantages associated with the prior art in that higher shear strength pressure sensitive adhesive tapes can be provided in roll form with a transparent to the core appearance in a relatively short time and without the need to subject the rolls to additional method steps. Moreover, the present invention achieves such transparent to the core appearance by sufficiently wetting-out the adhesive on the tape backing to remove microscopic air bubbles entrapped within the harder high shear strength adhesive layers.

Such pressure sensitive adhesive tape rolls comprising high shear strength tape with substantially complete adhesive wetting and thus a transparent to the core appearance can be accomplished by the method in accordance with the present invention including the steps of providing a supply roll of tape material; unwinding the tape material from the supply roll of tape material; and rewinding a length the unwound tape material onto a core to make a tape roll while providing a sufficient contact pressure to the non-adhesive major surface of the tape substantially at the application point of the tape to the tape roll. The tape material comprises a transparent backing layer with a non-adhesive major surface and a second major surface thereof coated with a transparent pressure sensitive adhesive layer and having a high shear holding strength. Moreover, the step of rewinding the unwound tape onto a core further comprises using a pressurized roller for providing the sufficient contact pressure to the non-adhesive major surface of the tape. Specifically, the step of providing a sufficient contact pressure by a pressurized roller comprises providing at least four pounds of pressure per lineal inch of the tape, and the high shear holding strength of the tape material is greater than 400 minutes as determined by ASTM Standard Test Method for Holding Power of Pressure Sensitive Tape.

In one aspect, the step of providing a sufficient contact pressure by a pressurized roller comprises providing at least ten pounds of pressure per lineal inch of the tape, and the method further comprises making pressure sensitive adhesive tape rolls that have a transparent to the core appearance at the time of the rewinding step.

In another aspect, the method further includes the step of aging the tape roll after the rewinding step is complete for allowing the tape roll to become transparent to the core after the rewinding step.

In accordance with the method of the present invention, the method comprises making the tape roll sufficiently transparent to the core so that the tape roll has at least a total percentage transmittance value of 45 percent as determined by ASTM D 1003 Standard Test Method for Haze and Luminous Transmittance of Transparent Plastics.

DETAILED DESCRIPTION

Figure 1:
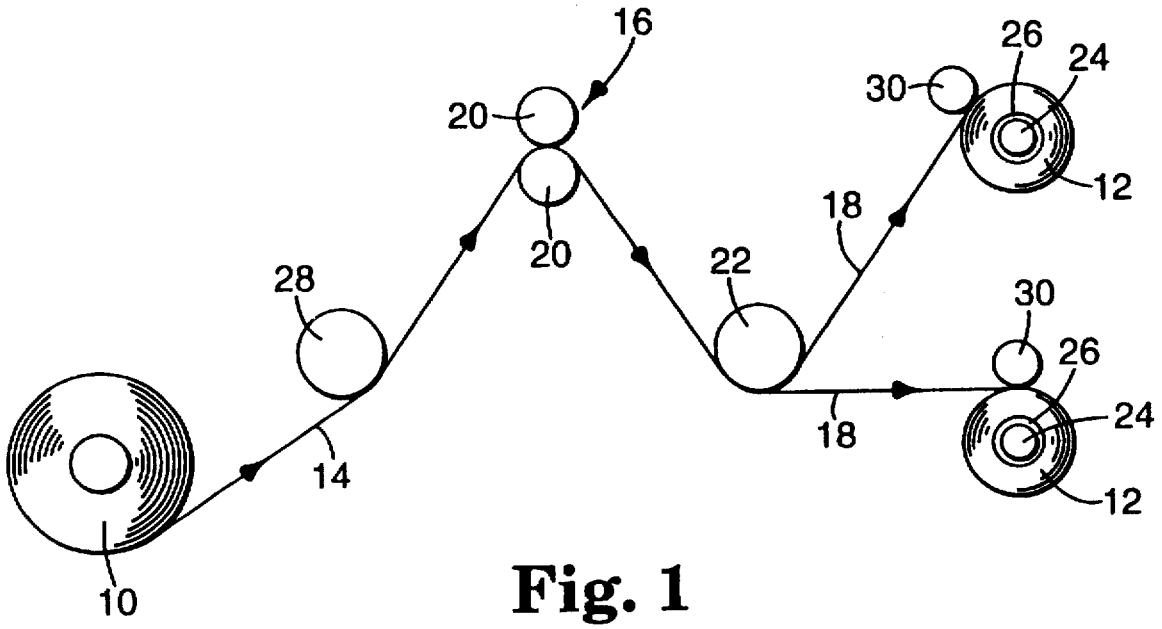
FIG. 1 is a schematic diagram of a slitting and rewinding operation in accordance with the method of the present invention.

Referring to the figures, and initially to FIG. 1, a method for slitting and rewinding pressure sensitive adhesive tape onto tape cores is illustrated. More specifically, with reference to FIGS. 1 and 2, the method of the present invention for producing transparent to the core pressure sensitive adhesive tape rolls is schematically illustrated.

As shown if FIG. 1, a supply roll of tape material 10 having an indefinite width and roll diameter is provided, from which a plurality of tape rolls 12 are made (the supply roll dimensions are defined by the ability to produce a large roll and the number of tape rolls to be made at once). In order to produce plural tape rolls from a single supply roll 10, a width of the tape material 14 is unwound from the supply roll 10 and is slit along its machine direction at a slitting station 16 into a plurality of tapes 18. The width of the tape material 14 equals the cumulative width of the tapes 18. Any number of tapes 18 can be made from a single supply roll 10 depending on the desired width of each tape 18, which may be different for each tape roll 12, and the width of the tape material 14. The slitting station 16 preferably comprises a series of conventional opposed cutting elements 20 which divide the tape material 14 into the tapes 18.

Plural driven winding shafts 24 are also preferably provided so that the tapes 18, after being run together over a roller 22, which may be an idler or driven roller, can be alternatingly rewound onto tape cores 26 provided on different winding shafts 24 so as to prevent edge interleaving. Conventionally, the tape cores 26 are frictionally driven by the driven winding shafts 24 for winding the plural tapes 18 at the same time by a center winding technique until a desire amount of tape is rewound on each tape core 26. In order to assist the unwinding of the tape material 14 from the supply roll 10, a pull roll 28 is also provided; however, the winding shafts 24 wind the tapes 18 into the tape rolls 12 with the tapes 18 under tension.

The method of the present invention basically includes the rewinding of an adhesive material onto a tape core under conditions as explained below. It is understood that the slitting operation does not form a critical portion of the method of the present invention, but comprises a part of a typical slitting/rewinding system that is used to slit large tape supply rolls down into smaller diameter plural tape rolls. Such slitting/rewinding machines are commercially available, such as from Guzzetti s.p.a. of Turate, Italy. It is further understood that a single tape roll could be unwound and then rewound in the manner as follows.

It is a specific object of the method of the present invention to make tape rolls 12 which are transparent to the core, as will be more clearly defined below. However, in addition to controlling the manner of rewinding in order to give the tape rolls a transparent to the core appearance, it is also necessary to start with sufficiently clear tape construction materials including the backing layer, the adhesive, and any low-adhesion backsize coating, if provided.

In the making of the supply rolls 10, from which the tape rolls 12 are produced, a suitable backing layer is provided onto one side of which a pressure sensitive adhesive is coated. A suitable backing layer may be provided from a roll of film or may be made directly as a film layer prior to the adhesive coating. Moreover, the backing layer, as noted above, needs to be sufficiently transparent; and that means that the film material should have a low percentage of haze as defined by the ASTM D 1003 Standard Test Method for Haze and Luminous Transmittance of Transparent Plastics, a modification of which is described below. Preferably, the percentage of haze should be below three percent (3%) to be considered sufficiently transparent for the present case. It is understood that there is a cumulative effect of such material when it is wrapped upon itself, such as in a roll form, and that it is this cumulative haze which defines "transparent to the core" rolls, see Example 5 below, with the adhesive layers and any other coatings contributing.

The method of making the backing layer does not form a part of the present invention, except that it is preferable that the film be of substantially even caliper over its entire width. In accordance with the process of making transparent to the core tape roll, described below, caliper variations in the backing layer can be a factor in obtaining tape roll clarity for which compensation of other factors might have to be made. Backing layer films can be suitably made by various extrusion methods that are well known in the art and may include orientation of the film.

A non-exclusive list of conventional polymeric backing layer films follows with the understanding that any could be suitable for making transparent to the core tape rolls that are otherwise suitable for use as a tape backing layer and which are sufficiently transparent, as described above: polyethylene, polypropylene, polyester (such as polyethylene terepthalate (PET)), biaxially oriented polypropylene (BOPP), polyvinyl chloride (PVC), copolymers of propylene and ethylene, and copolymers of ethylene and olefins having four or more carbon atoms.

In a similar sense as the backing layer films, the pressure sensitive adhesive to be coated on the backing layer should also be sufficiently transparent. In fact, what is most important is not that the backing layer and the adhesive layer themselves are sufficiently transparent, but that the combination of the backing layer and the adhesive be sufficiently transparent (this may actually improve after they are combined).

Moreover, the present invention is directed to the making of tape rolls having a transparent to the core appearance for tapes having relatively high shear holding strength adhesives as defined according to the ASTM method D-3654 Standard Test Method for Holding Power of Pressure Sensitive Tapes. As set out in the Background section of the subject case, high shear holding strength adhesives are those having a value of more than 400 minutes of holding power. Adhesives below 400 minutes of holding power, such as most acrylate-based adhesives, are typically soft and easily deformable, while those above tend to be harder and become significantly less deformable as the holding power increases.

Suitable high shear holding strength adhesives for use in the method of the present invention are those having shear holding strength values of greater than 400 minutes, and more preferably greater than 1000 minutes, and which may be generally based on general compositions of polyacrylate; polyvinyl ether; diene-containing rubber such as natural rubber, polyisoprene, and polybutadiene; styrene-butadiene rubber; polychloroprene; butyl rubber; butadiene-acrylonitrile polymer; thermoplastic elastomer block copolymers such as styrene-isoprene (SI) and styrene-isoprene-styrene (SIS) block copolymers, styrene-butadiene (SB) and styrene-butadiene-styrene polymers (SBS), and ethylene/propylene and ethylene-butylene-diene polymers such as styrene-ethylene/propylene-styrene (SEPS) and styrene-ethylene/butylene-styrene (SEBS); poly-alpha-olefin; amorphous polyolefin; silicone; ethylene-containing copolymer such as ethylene vinyl acetate, ethyl ethyl acrylate, and ethyl methacrylate; polyurethane; polyamide; epoxy; polyvinylpyrrolidone and vinylpyrrolidone copolymers; polyesters; and mixtures of the above. The use of many of these compositions to give high shear strength adhesives may require cross-linking or curing by methods well known in the art. Additionally, the adhesives can contain additives such as tackifiers, plasticizers, antioxidants, stabilizers, curatives, and solvents.

The manner of coating the adhesive on the backing layer also does not form a critical part of the present invention and any known conventional techniques can be utilized. As above with regard to film caliper, it is also preferable to control the adhesive layer coating to provide a substantially even caliper layer, which if uneven may require compensation by other factors.

It is also typical to provide a low adhesion backsize to the other side of the backing layer so that the tape separates more easily when unwound from the tape rolls. Such coatings and/or treatments are well known, and any can be used in accordance with the present invention if they are otherwise suitable for use in the desired tape construction. Again, the low-adhesion backsize, or more accurately the combination thereof with the backing layer and the adhesive, should be sufficiently transparent.

Figure 2:
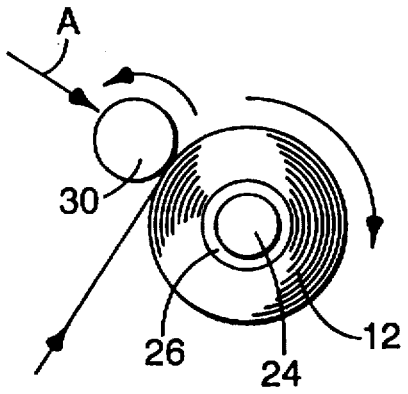
FIG. 2 is an enlarged schematic diagram of a center driven tape roll being rewound with the assistance of a pack roll for applying a sufficient pressure against the tape roll to make transparent to the core tape rolls in accordance with the method of the present invention.

Referring again to the process illustrated in FIGS. 1 and 2, the method of the present invention includes the unwinding of tape material 14 from a supply tape roll 10 and the subsequent rewinding of the tape 18 onto tape core 26 to make tape rolls 12. Slitting is also typically done between the supply roll unwinding and the individual tape roll 12 rewinding to narrow the width of the tape material 14 to a number of tapes 18.

In the rewinding of the individual tape rolls 12, after slitting, the tape 18 is wound about each core with the adhesive layer of each subsequent wind against the treated non-adhesive surface of the backing material of the previous layer. During this rewinding operation, microscopic and sometimes even more macroscopic air pockets become entrapped within the adhesive layers between subsequent backing layers. More specifically, the air pockets form within the adhesive layer and at the interface of the adhesive layer to the non-adhesive surface of the previous backing layer. Thus, even with the use of transparent backings and adhesives, the trapped air pockets, particularly the microscopic pockets, give the finished tape roll an overall cloudy or non-transparent appearance.

The winding technique illustrated in FIGS. 1 and 2 is a center-wind method wherein the core 26 that is being wound with tape is driven about its central axis defined by the driven winding shaft 24. In regard to pressure sensitive adhesive tapes, center-winding is the prevalent basic method of winding such tapes.

In addition to driving the winding shaft 24 to rewind the tape rolls 12, a "top-riding roll" or "pack roll" 30 is provided at each application point of the tapes 18 to each tape roll 12 that is being rewound. The pack rolls 30 are urged so as to apply a controlled force, illustrated by arrow A in FIG. 2, against the outer surface of the tape rolls 12 at the application point of the tape 18 to the tape roll 12 while the cores 26 are driven by the winding shafts 24. The pack rolls 30 may be idlers or may also be driven to assist in controlling and reducing tape tension. Moreover, the pack rolls 30 are preferably independently conventionally urged against the tape rolls 12 during rewinding in any manner, such as by hydraulic pressure, mechanical pressure devices, pneumatic pressure, or the like so that each can float to follow the individual tape rolls 12. Preferably, the manner of applying the pressure is controllable so as to maintain a substantially constant pressure during the rewinding operation.

As illustrated in FIG. 2, the pressure of each pack roll 30 is preferably applied to the rolls 12 at the application point of the tape 18 to each roll 12 in the general direction of arrow A. The amount of contact pressure applied is a major factor in making tape rolls having high shear holding strength adhesives, as set forth above, with a transparent to the core appearance in a rewinding operation. In this regard, Example 1 below sets out the contact pressures applied by such pack rolls 30 in the manner as illustrated for a number of tapes and adhesives of various high shear holding strength values starting at about 400 minutes, as defined by ASTM D-3654 Standard Test Method.

The contact pressures applied by the pack rolls 30, in accordance with the method of the present invention, are significantly higher than those associated with conventional pack roll type slitters. As stated in the Background section, conventional pack rolls apply about two (2) pounds per lineal inch (PLI) or less of pressure primarily for the purpose of removing macroscopic air bubbles and removing wrinkles.

However, as also set forth above, it is required that the microscopic air bubbles that form within the adhesive layer of a transparent adhesive or between the adhesive and the transparent backing tape during rewinding be substantially eliminated in order to produce a tape roll 12 having a transparent to the core appearance. That is, substantially complete wetting of the adhesive on the backing layer must be achieved. When dealing with higher shear holding strength adhesives it is increasingly more difficult to wet the adhesive and eliminate these microscopic air bubbles because the adhesives increasingly become harder and less deformable. In accordance with the method of the present invention exemplified below, it has been discovered that with high enough contact pressures, substantially complete adhesive wetting can be achieved and transparent to the core tape rolls can be made for these high holding strength adhesives.

Moreover, under many circumstances, transparent to the core tape rolls can be made immediately during the rewinding process. In particular, with adhesives approaching the lower end of the higher holding strength values, around 400 minutes, see Example 1 below, it has been determined that a contact pressure of about 10 PLI is required to make transparent to the core tape rolls immediately after rewinding which comprise 50 yards of tape on a three (3) inch diameter core. As used throughout this application, the term pounds per lineal inch (PLI) is determined by dividing the pressure applied to the pack roll by the width of the tape in inches. It is understood that the pressure is actually applied over a contact area determined by the diameter of the pack roll, the durometer of the pack roll, the tape material and the diameter of the core onto which the tape is being wound. By reducing the contact area, the applied pressure can actually be reduced. As the shear holding strength values increase, so does the needed contact pressure. However, in some cases, the tape rolls clear up over time.

Thus, another related factor in making tape rolls comprising high shear holding strength adhesives with a transparent to the core appearance is aging. Although it is known generally that some tapes clear up over time with little or no applied pressure during rewinding, it has been discovered that the application of high pack roll pressure during rewinding significantly reduces the time that it takes. In other words, the adhesive wetting may be improved but not substantially completed by the pack roll pressure during rewinding, and such substantially complete adhesive wetting occurs over a relatively short time. During the aging period, the remaining microscopic air bubbles between layers are believed eliminated because of the expansion and contraction of the tape, the escape of the air through the tape, and possibly the absorption of the air into the adhesive. Although this happens to tapes made without the benefit of high pack roll pressure, without it, tapes with high shear holding strength adhesives may never clear up or it would take so long that it is effectively never. Furthermore, with greater pack roll pressures, the time is reduced. Examples 3 and 4 below show the effect of aging on tape clarity when the rolls are rewound under various contact pressures. More specifically, it has been determined that with rewinding pack roll pressures as low as about four (4) PLI, 60 yard tape rolls on three (3) inch diameter cores will clear up at about 27 days. On the other hand, with 100 yard tape rolls on three (3) inch cores, they do not clear up in the same time period.

Thus, it is also shown that the length of the tape roll, that is the number of wraps of tape on the core, is a significant factor in obtaining transparent to the core tape rolls. As shown specifically in Table 2 within Example 2 below, a number of tapes were rewound under a high pack roll contact pressure of 30 PLI to determine the length of each tape that could be wound on a three (3) inch diameter core and be made immediately transparent to the core. This data shows the cumulative effect of the haze of the backing layer and the adhesive after multiple wraps. Other factors affecting the ability to make transparent to the core tape rolls are detailed below.

For the purposes of the present invention, it has been determined that a significant number of wraps of tape must be provided around a particular tape core to define a tape roll having a transparent to the core appearance. For commercial considerations and because tape length is a significant factor in making transparent to the core tape rolls, it has been determined that a minimum of fifty (50) wraps of tape around a core (of any size) is required to define such a product. Each successive wrap adds to the cumulative effect of the haze of each layer, each layer of which comprises the backing layer, adhesive and low-adhesion backsize, if provided, as described above. Below this minimum, even more hazy tapes may produce transparent to the core tapes as defined by the present invention.

Another factor that affects the ability to make tape rolls transparent to the core is the caliper variation of the backing layer and adhesive. It is preferred that the caliper variation be below one percent (1%) so as to substantially eliminate any significance. If, however, the caliper variation is greater than one percent (1%), then one or more of the other factors may need to be adjusted. Specifically, such greater variations can be compensated for by increasing the applied contact pressure of the pack rolls. Moreover, reducing the pack roll durometer is another way to compensate. For example, in order to compensate for a caliper variation, a rubber pack roll would need less of an increase of contact pressure than would a steel roll. The rubber roll would more evenly apply the increased pressure, while a steel roll would have to crush more of those areas of higher caliper.

Other factors of less significance include the line speed of the rewinding operation and the web tension of the tape during rewinding. Variations in both of these factors can be compensated for by minimal adjustment of pack roll contact pressure. Moreover, the significance of these factors becomes greater as the shear holding strength values of the adhesive is lower, which is where the effect of contact pressure is the greatest.

EXAMPLE 1

The amount of pack roll force needed to give essentially complete wetting of the adhesive layer, resulting in a clear roll of tape immediately after winding, was determined for a series of high shear adhesives tapes having adhesive shear values ranging from about 400 minutes to several thousand minutes as measured by ASTM D 3654, Standard Test Method for Holding Power of Pressure Sensitive Tape. To measure the degree of clarity of each tape roll, the cores were wrapped with "eye chart" type paper that contained the alphabet printed in various sizes. After winding the tape roll, each roll was graded based on the ability to read the "eye chart" through the tape. Rolls were rated from 0–7, with 7 being the case where the smallest printing (1.3 mm high) could be clearly seen, and 0 being the case where even the largest letters (5.8 mm high) were not clear. The rating scale is shown below:

| | |
|---|---|
| 1 | 5.8 mm |
| 2 | 5.5 mm |
| 3 | 4.5 mm |
| 4 | 4.3 mm |
| 5 | 3.7 mm |
| 6 | 2.8 mm |
| 7 | 1.3 mm |

The pack roll pressure needed to obtain a clear roll, as indicated by a rating of 7 on the visual determination, is dependent on the thickness and ease of deformability of the adhesive layer, as measured by the shear, and on the roll length.

Sample 1 was a biaxially oriented polypropylene backed packaging tape with a styrene-isoprene-styrene (SIS) rubber/resin type adhesive available from Intertape Corporation, Danville, Virginia, as box sealing tape #7100. A 50 yard roll was pack roll wound on a 3 inch core at a line speed of 300 feet per minute (91.2 m/min.) using a winding tension of 0.5 pounds per lineal inch (8.76 N/100 $m^2$) to give a clear roll as indicated below. Samples 2, 3, 4 and 5 are similar biaxially oriented polypropylene backed SIS rubber/resin packaging tapes having different calipers as indicated in Table 1 and are available from 3M Company, St. Paul, Minn., as packaging tape #369, #371, #373 and #375 respectively. Again, 50 yard rolls were pack roll wound on 3 inch cores under the conditions described for sample 1, and the pack roll forces needed to give essentially complete wetting resulting in a clear to the core tape roll for each sample are shown in Table 1. The shear values listed for sample 1 represent the averages of three individual shear values as determined by ASTM D 3654, while the shear values listed for samples 2, 3, 4 and 5 are minimal shear values listed in the product literature.

TABLE 1

Pack Roll Pressure Needed to Obtain Clear Tape (50 yard rolls on 3 inch cores)

| | Caliper Backing | | Caliper Adhesive | | Shear | Pack Roll | |
|---|---|---|---|---|---|---|---|
| Sample | (mil) | (um) | (mil) | (um) | (min) | (PLI) | (N/100 mm) |
| 1 | 1.1 | 27.9 | 0.9 | 22.9 | 360 | 10 | 175 |
| 2 | 1.0 | 25.4 | 0.6 | 15.2 | 1,000 | 17.5 | 306 |
| 3 | 1.2 | 30.5 | 0.8 | 20.3 | 3,000 | 20 | 350 |
| 4 | 1.6 | 40.6 | 1.0 | 25.4 | 8,000 | 25 | 438 |
| 5 | 2.0 | 50.8 | 1.2 | 30.5 | 12,000 | 35 | 613 |

From this data, it appears that a pack roll force of at least 10 PLI (175 N/100 $m^2$) is needed to obtain clear tape rolls of 50 yard lengths on 3 inch cores immediately after pack roll winding tapes when the tape comprises an adhesive with a shear value of about 400 minutes as measured by ASTM D 3654, and for preferred higher shear adhesives, having shear values of at least 1000 minutes, a pack roll force of at least 15 PLI (263 N/$m^2$) is needed. As seen in the table, the shear value of the adhesive, and therefore the minimum pack roll force needed to achieve nearly complete wetting to give a clear to the core appearance, is dependent on the thickness of the adhesive layer as well as the deformability as determined by the adhesive composition.

EXAMPLE 2

In order to verify that the method of pack roll slitting will produce clear-to-the core tape with a variety of backings and adhesives, several other types of tapes were pack roll wound at a pressure of 30 pounds per lineal inch (PLI) [525 Newtons per lineal 100 mm] onto 3 inch cores. All tapes were obtained from 3M Company, St. Paul, Minn., under the product numbers listed. Sample 1, available as tape #8886, was a tape having a 6 mil (152 um) linear low density polyethylene backing coated with 6 grains/24 sq. in. (25.2 grams/$m^2$) of a SIS rubber/resin adhesive; the total thickness of the tape sample was about 7.2 mil (182.9 um). Sample 2, available as tape #5912, was a tape having a 1.5 mil (38.1 um) cellophane backing coated with 5 grains/24 sq. in. (21 grams/$m^2$) of a SIS rubber/resin adhesive; the total thickness of the tape sample was about 2.4 mil (61 um). Sample 3, available as tape #355, was a tape having a 2 mil (50.8 um) polyester backing coated with 8 grains/24 sq. in. (33.6 grams/$m^2$) of a SIS rubber/resin adhesive; the total thickness of the tape sample was about 3.5 mil (88.9 um). Sample 4, available as tape #610, was a tape having a 1.4 mil (35.6 um) cellophane backing coated with 5.5 grains/24 sq. in. (23.1 grams/m$^2$) of a natural rubber/resin adhesive; the total thickness of the tape sample was about 3 mil (76.2 um). Sample 5, available as tape #681, was a tape having a 1.46 mil (37.1 um) unplasticized polyvinyl chloride (UPVC) backing coated with 5.3 grains/24 sq. in. (22.3 grams/m$^2$) of a natural rubber/resin adhesive; the total thickness of the tape sample 4 was about 3 mil (76.2 um). The roll length of each sample varied, as shown in Table 2.

TABLE 2

Clear-to-the-core Tapes

| Tape sample | Roll length (yd) | Roll length (m) | Rating |
|---|---|---|---|
| #1 | 6 | 5.5 | 7 |
| #2 | 26 | 23.8 | 7 |
| #3 | 18 | 16.5 | 7 |
| #4 | 35 | 32 | 7 |
| #5 | 42 | 38.5 | 7 |

This data indicates that the tape samples analyzed all became clear when pack roll wound at a pressure of 30 PLI (525 N/100 mm) up to the indicated lengths, after which point the clarity deteriorated. However, the clarity was mostly affected by the cumulative haze of the various tape backings exemplified.

EXAMPLE 3

A supply roll of tape material, available from 3M Italia s.p.a., Bergamo, Italy as tape number 3701, was converted into tape by a slitter/rewinding operation. The tape material comprised a 1.1 mil (27.9 um) BOPP backing coated with 4 grains/24 sq. in. (16.8 grams/m$^2$) of a SIS rubber/resin type adhesive. The finished supply roll was 51 inches (129.5 cm) wide by 3000 yards (2,734 m) long on a 3 inch diameter (7.6 cm) paper core. The tape was slit into 60 yard (54.9 m) and 100 yard (91.4 m) long rolls at 100 feet per minute (30.4 m/min) using a pack roll force of approximately 4.1 PLI (71.8 N/100 mm). Opaque bands appeared in several tape rolls located at positions towards the ends of the winding bar due to caliper variation in the supply roll. Rolls from the center of the bar did not show the opaque bands, so representative center rolls were analyzed to determine the degree of clarity of the finished tape roll. The clarity of the rolls was determined as described in Example 1. immediately after slitting (initial) and after 9, 14 and 27 days natural aging. Duplicate 60 yard (54.9 m) rolls, but only single 100 yard (91.4 m) rolls, were made and rated as summarized in the Table 3.

TABLE 3

Clarity vs. Aging Time at 4.1 PLI (71.8 N/100 mm)

| Aging time | Visual rating 60 yd (54.9 m) | Visual rating 100 yd (91.4 m) |
|---|---|---|
| Initial | 0 | 0 |
| initial | 0 | — |
| 9 days | 3 | 0 |
| 9 days | 2 | — |
| 14 days | 6 | 0 |
| 14 days | 5 | — |
| 27 days | 7 | 0 |
| 27 days | 7 | — |

This data shows that 4.1 PLI (71.8 N/100 mm) pack roll force is not enough to give a clear tape immediately after winding for this type of adhesive, which has an extremely high shear value of greater than 3000 minutes and is difficult to deform to give complete wetting, but that the 60 yard (54.9 m) rolls of tape produced do become clear after about 27 days natural aging when a pack roll pressure of about 4.1 PLI (71.8 N/100 mm) is used. The 100 yard (91.4 m) rolls of tape were not clear even after 27 days natural aging using a pack roll pressure of 4.1 PLI (35 and 71.8 N/100 mm).

EXAMPLE 4

Another set of tape rolls was prepared from box sealing tape #371, available from 3M Company, St Paul, Minn. The #371 tape had a 1.2 mil (30.5 um) biaxially oriented polypropylene (BOPP) backing and a 0.8 mil (20.3 um) SIS rubber/resin adhesive coating, giving a total tape caliper of about 2.0 mils (50.8 um). Duplicate rolls were pack roll wound into 100 meter rolls at a line speed of 1000 feet per minute (304.8 m/min) and a winding tension of 0.74 PLI (13.0 N/100 m$^2$) at pack roll pressures of about 6.72, 10, 15, 20, 25 and 30 PLI (117.5, 175.1, 262.7, 350.2, 437.8, 525.4 N/100 mm, respectively). The duplicate rolls were rated after 1, 4, 6, 13, 19, 28, 41, 63 and 103 days natural aging as described in Example 1. The results are summarized in Table 4.

TABLE 4

Clarity vs. Aging Time at Several Pack Roll Pressures

| Pack roll pressure (PLI) [N/100 mm] | Rating after days natural aging: 1 | 4 | 6 | 13 | 19 | 28 | 41 | 63 | 103 |
|---|---|---|---|---|---|---|---|---|---|
| 6.72 [117.5] | 0 | 0 | 0 | 0 | 0 | 0 | 0–6 | 0–6 | 0–7 |
| 6.72 [117.5] | 0 | 0 | 0 | 0 | 0 | 0 | 0–3 | 0–3 | 0–4 |
| 10 [175.1] | 0 | 0 | 0 | 0 | 0 | 0 | 0–3 | 0–3 | 0–3 |
| 10 [175.1] | 0 | 0 | 0 | 0 | 0 | 0 | 0–3 | 0–3 | 0–3 |
| 15 [262.7] | 0 | 0 | 0 | 0 | 0 | 0 | 5 | 5 | 6 |
| 15 [262.7] | 0 | 0 | 0 | 0 | 0 | 0 | 0–4 | 0–6 | 0–7 |
| 20 [350.2] | 0 | 0 | 0–2 | 0–2 | 0–5 | 0–5 | 6 | 6 | 7 |
| 20 [350.2] | 0 | 0 | 0–7 | 0–7 | 0–7 | 0–7 | 0–7 | 7 | 7 |
| 25 [437.8] | 0 | 0 | 0–2 | 0–2 | 0–5 | 6 | 6 | 7 | 7 |
| 25 [437.8] | 0 | 0 | 0–6 | 0–6 | 6 | 6 | 7 | 7 | 7 |
| 30 [525.4] | 0 | 0 | 0–7 | 0–7 | 6 | 7 | 7 | 7 | 7 |
| 30 [525.4] | 0 | 0 | 1–7 | 7 | 7 | 7 | 7 | 7 | 7 |

When ranges are given for the visual ratings in Table 4, it indicates a transition roll with some portions of the roll having improved clarity as indicated by the high end rating and other portions having poor clarity as indicated by the low end rating. The data shows that 100 meter rolls of clear tape are obtained after about 63 days natural aging when a pack roll pressure of about 20 PLI (350.2 N/100 mm) is used, after about 41 days when a pack roll pressure of about 25 PLI (437.8 N/100 mm) is used, and after about 19 days when a pack roll pressure of about 30 PLI (525.4 N/100 mm) is used.

EXAMPLE 5

In order to correlate the visual rating obtained from looking through the tape roll at a standard "eye chart" core with a method for determining roll clarity that is not dependent on the eye chart, type of tape, or roll length, several tape samples covering the range of visual ratings were analyzed using ASTM D 1003, Standard Test Method for Haze and Luminous Transmittance of Transparent Plastics, with the following options, modifications and sample preparation:

(1) As allowed in the method, a scanning spectrophotometer with integrating sphere was used in place of a dedicated Haze meter. The instrument used was a Perkin Elmer Lambda 19 with RSA-19 integrating sphere. The following conditions were used:

(a) wavelength range=830–360 nm
(b) slit width=4 nm
(c) mode=transmittance (% T)
(d) data interval=0.5 nm
(e) scan speed=240 nm/min.

(2) A special fixture was made with a 3.375 inch (8.57 cm) diameter cylindrical convex curvature on the front side and a flat back side, and a 1.00 inch (2.54 cm) diameter port. This fixture allowed consistent mounting of samples against the sample beam port of the integrating sphere without distorting the samples. The sample beam port is 0.875 inches (2.22 cm) in diameter, so the fixture did not mask the beam.

(3) Samples were prepared by (a) cutting the individual tape rolls into roughly quarter segments with a bandsaw; (b) removing only the core from the layered tape windings; (c) removing the adhesive layer from the innermost tape backing layer of the intact tape windings using a heptane-moistened cloth; (d) measuring the sample thickness by micrometer; (e) mounting the tape sample on the fixture described above; and (f) analyzing the sample in front of the integrating sphere as prescribed in ASTM D 1003.

(4) In addition to the normal Haze measurement whose calculation is described in D 1003, the total diffuse transmittance (also described in D 1003) versus subjective acceptability was correlated. For this calculation, the % $T_{total}$ (sample and white plate in place) was summed for all wavelengths at 5 nm intervals, and this sum was divided by the sum of % $T_{100}$ for all wavelengths at 5 nm intervals (white plate in place; no sample.) Weighting for ASTM CIE Source A and y-bar values cancel out in this calculation. The correlation between visual rating and total % Transmittance is shown in Table 5.

TABLE 5

Clarity Rating vs. % Transmittance

| Roll length (m) | Rating | Total % T |
|---|---|---|
| 60 | 7 | 56.2 |
| 100 | 0 | 16.3 |
| 100 | 7 | 48.8 |
| 25 | 0 | 22.5 |
| 25 | 0 | 24.9 |
| 25 | 0 | 31.8 |
| 25 | 6 | 41.7 |
| 25 | 7 | 63.7 |
| 25 | 7 | 74.1 |
| 25 | 7 | 76.2 |
| 25 | 7 | 80.2 |
| 25 | 7 | 82.0 |

From this data, it appears that a total % T value of about 45% or higher corresponds to a visual rating of 7. Therefore, any tape roll having a % T of 45% or higher as measured by the modified ASTM Method D 1003 described above, regardless of the backing type or caliper, adhesive type and thickness, or the length of tape, should be "clear to the core" as defined herein.

We claim:

1. A method of making pressure sensitive adhesive tape rolls that have a transparent to the core appearance comprising the steps of:

providing a supply roll of tape material, the tape material comprising a transparent backing layer with a non-adhesive major surface and a second major surface thereof coated with a pressure sensitive adhesive layer and having a high shear holding strength that is greater than 400 minutes as determined by ASTM Standard Test Method for Holding Power of Pressure Sensitive Tape;

unwinding the tape material from the supply roll of tape material;

rewinding a length the unwound tape material onto a core to make a tape roll having at least fifty wraps while using a pressurized roller for providing sufficient contact pressure of at least ten pounds of pressure per lineal inch of the tape to the non-adhesive major surface of the tape substantially at the application point of the tape to the tape roll, wherein the pressure sensitive adhesive tape rolls have a transparent to the core appearance at the time of said rewinding step.

2. The method of claim 1, wherein the high shear holding strength of the tape material is greater than 1000 minutes as determined by ASTM Standard Test Method for Holding Power of Pressure Sensitive Tape.

3. The method of claim 1, further including the step of aging the tape roll after the rewinding step is complete for allowing the tape roll to become transparent to the core after said rewinding step.

4. The method of claim 1, wherein said method comprises making the tape roll sufficiently transparent to the core so that the tape roll has at least a total percentage transmittance value of 45 percent as determined by ASTM D 1003 Standard Test Method for Haze and Luminous Transmittance of Transparent Plastics.

5. The method of claim 1, further comprising the step of slitting the tape material into plural tapes and rewinding plural tape rolls having a transparent to the core appearance at the same time.

* * * * *